United States Patent [19]

Abildgaard et al.

[11] Patent Number: 4,708,560

[45] Date of Patent: Nov. 24, 1987

[54] BOOKBINDING METHOD USING STRIPS

[75] Inventors: William H. Abildgaard, Redwood City, Calif.; Karl Hymmen, Sparks, Nev.

[73] Assignee: VeloBind, Inc., Sunnyvale, Calif.

[21] Appl. No.: 766,790

[22] Filed: Aug. 19, 1985

[51] Int. Cl.[4] ..... B42C 1/00; B42B 5/08; B42F 3/04; B42F 13/00

[52] U.S. Cl. ..... 412/7; 24/67 P; 24/153.1; 281/21 R; 402/1; 402/80 R; 412/33; 412/38; 412/43

[58] Field of Search ..... 412/6, 7, 33, 38, 43; 281/21 R, 25 R; 283/23; 402/1 R, 80 R, 80 P; 24/153.1, 153, 67.5, 67 P

[56] References Cited

U.S. PATENT DOCUMENTS

| | | | |
|---|---|---|---|
| 210,885 | 12/1878 | Van Benschoten | 402/74 |
| 1,452,565 | 4/1923 | McBee | 412/43 |
| 3,757,389 | 9/1973 | Wiland | 402/1 |
| 4,369,013 | 1/1983 | Abildgaard | 412/38 |
| 4,525,899 | 6/1985 | Carroll | 24/67 P |

FOREIGN PATENT DOCUMENTS

| | | | |
|---|---|---|---|
| 68999 | 5/1914 | Switzerland | 402/1 |
| 462778 | 11/1968 | Switzerland | 402/1 |

*Primary Examiner*—Howard N. Goldberg
*Assistant Examiner*—Taylor J. Ross
*Attorney, Agent, or Firm*—Julian Caplan

[57] ABSTRACT

A male bookbinding member comprises a relatively thin, narrow strip having studs projecting therefrom at intervals. The ends of the studs are formed as male paper punches. A female paper punch comprises a female bookbinding strip having holes at the same intervals as the studs. Individual or small batches of paper (or other sheet material) are brought into position overlying the female punch. The male member advances toward the sheets punching them in cooperation with the female strip. The paper remains on the studs. The operation is repeated until all the sheets of the book are on the studs. The strips are forced together, excess stud lengths cut off and heads formed on the ends of the studs to rivet the book together or the strips are held together by other means. Alternatively, a hardened female punch die is used and the female binding strip brought into contact with the studs after the sheets are assembled thereon.

6 Claims, 60 Drawing Figures

BOOKBINDING METHOD USING STRIPS

BACKGROUND OF THE INVENTION

1. Field of the Invention

This invention relates to a new and improved bookbinding method and strips for bookbinding. More particularly, the invention relates to binding books wherein the male binding strip studs are formed with punch members at their outer ends. The punch members on the ends of the studs cooperate with the holes in the female strip to punch sheets interposed therebetween, the punched sheets accumulating on the studs until the entire stack of sheets has accumulated. The strips are then compressed with the paper therebetween, excess stud lengths are cut off and heads are formed on the ends of the studs to bind the book together. Other means for securing the book assembled may be employed.

2. Related Art

A method of binding books is disclosed in U.S. Pat. No. 3,756,625, said method involving the use of male and female binding strips. Such strips are also disclosed in U.S. Pat. No. 4,369,013. In order to use the strips of the U.S. Pat. No. 4,369,013 patent, holes must be punched at or near the spine edges of the pages to be bound. Heretofore, several methods of forming such holes have been employed. Machines such as those disclosed in U.S. Pat. No. 3,756,625 frequently have incorporated therein a punch, which punches sheets with holes in the proper location and of the proper size. In other instances, separate punches, either manual or motor operated, punch the holes. In both foregoing instances, punching is a separate operation and the punched sheets must be assembled in a stack, operations which involve skill and effort.

Still another alternative is to pre-punch the sheets at a paper mill or fabricator. Again, such sheets must be assembled and the studs fitted into the holes in the sheets, again involving skill, time and effort.

One principal advantage of the present invention is that the male strip itself is one of the punch members and the punched sheets remain in position on the studs, until the stack which is to comprise the book has been assembled. This eliminates the necessity of assembling the sheets. Thus there is a considerable amount of time saved and the skill required of the operator is reduced.

The cost of a separate punch is also saved.

Another feature of the present invention is that the male punch elements are themselves used as binding strips for the book, in effect, comprising disposable punch elements. Thus the punch is continually renewed for each book.

In the preferred embodiment of the invention, the female strip is likewise one of the punch elements. After the sheets are assembled on the studs, the two strips are compressed, excess stud lengths cut and rivet heads formed. For such purpose, the underside of the female strip may be formed with depressions or counterbores into which the rivet heads are received.

In an alternative form of the invention, a separate, hardened female punch die is used. After all the sheets are punched and they are stacked on the male strip during the punching operation, the female binding strip is assembled on the stud. Excess stud lengths and heads are formed as in the previously described modification.

Alternatively, if the holes in the female strip are of proper dimension, the studs may be driven into said holes with a force fit and the excess lengths cut off. In such instances, the book is held assembled by friction. Such an operation simplifies the equipment used and eliminates cutting and head forming.

Other objects of the present invention will become apparent upon reading the following specification and referring to the accompanying drawings in which similar characters of reference represent corresponding parts in each of the several views.

FIGS. 25–42, inclusive, are fragmentary elevational views of the lower ends of modified stud constructions;

FIGS. 25A to 42A, inclusive, are bottom plan views of the structures of FIGS. 25–42, respectively.

3. Description of Preferred Embodiment

Figure 1:
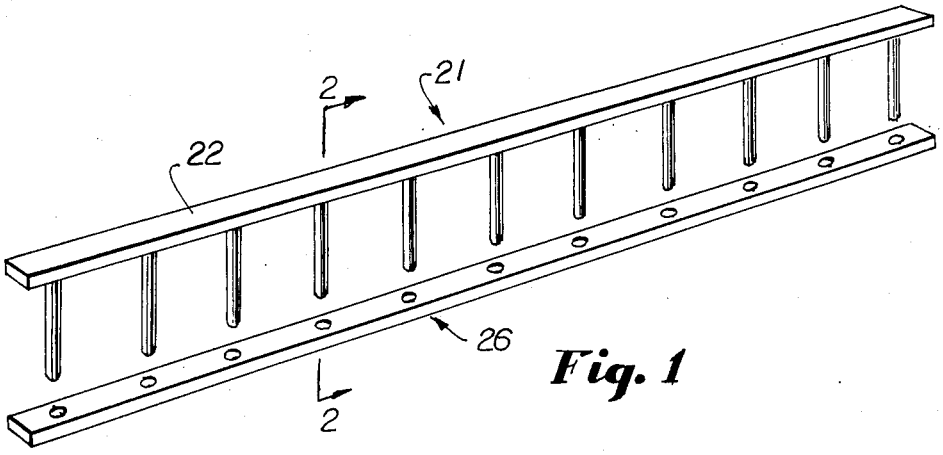
FIG. 1 is a perspective view of strips in accordance with the present invention.

Male binder element 21 comprises a narrow, thin strip 22, which is preferably substantially rectangular in cross-section. Projecting at spaced intervals along the length of strip 22 are studs 23. In the form of the invention shown in FIGS. 1 and 2, the studs are round and the outer end of each stud 23 is formed with a punch member 24 which is shown to be arcuate, the arc being centered about an axis perpendicular to the length of stud 23 and substantially below the lower end of studs 23. Other modifications are hereinafter described.

Female binding element 26 has a strip 25 substantially the same as strip 22, but formed at intervals corresponding to the spacing of studs 23 with holes 27. The clearance between the outside diameter of studs 23 and the inside diameter of hole 27 is such as to punch sheets of paper, cover material and the like, which may be positioned therebetween. The bottom of strip 25 is formed with counterbores 29 around the holes 27 to receive rivet heads as hereinafter explained. The upper longitudinal edges of strip 25 may be formed with recesses or reliefs 32 similar to reliefs 31.

Various plastic materials may be used for elements 21 and 26, such as polyvinylchloride, polystyrene, ABS and other. To add strength, fibreglass may be mixed with the plastic. Moldable metals such as aluminum alloys may be used instead of plastics.

Figure 19:
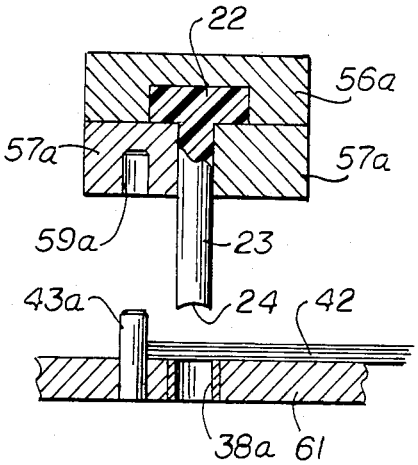
FIG. 19 is a schematic view similar to FIG. 5 of a modified method of forming a book.

The male strip 22 is received in a groove 55 in upper clamp 56, below strip 22 are guides 57 which move together as shown in FIG. 19. The semi-circular grooves 58 in each guide 57 are complementary to one-half of stud 23. The lower guides 51 move together to grip the upper ends of the studs 23 to hold them in line.

In order to hold the female binding element 26 in place, movable clamps 36 have inward directed edges 37 complimentary to reliefs 32 which grip and hold the female strip 25 against lateral movement. To restrain against longitudinal movement, sleeves 38 project up above support 33 and enter counterbore 29. The I.D. of sleeves 38 is greater then the O.D. of studs 23. Pin 43 serving as a paper locating stop is received in holes in one of the guides 57.

Figure 4:
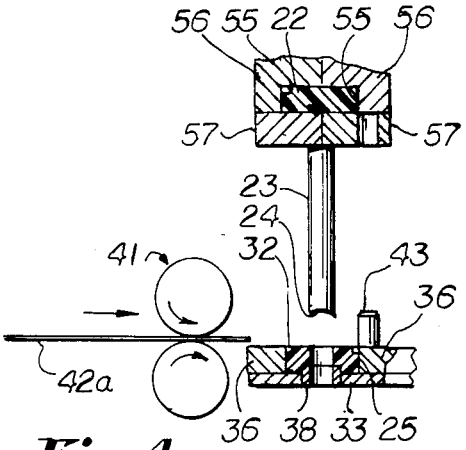
FIG. 4 is a schematic end elevational view showing the first step in the method of the present invention, namely, the feeding of a sheet or batch of sheets between the punch members.
Figure 5:
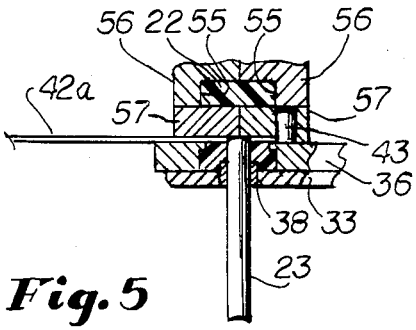
FIGS. 5, 6, 7, 8, 9, 10 and 11 are views show sequential steps in the formation of the book.
Figure 6:
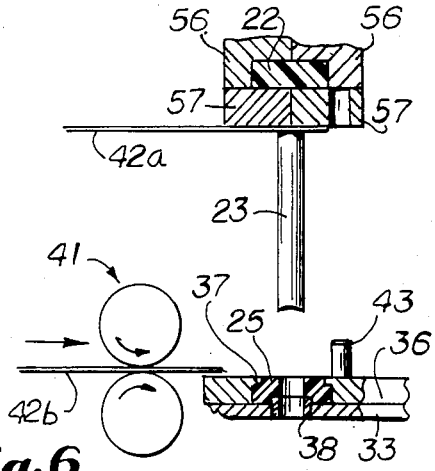
Figure 7:
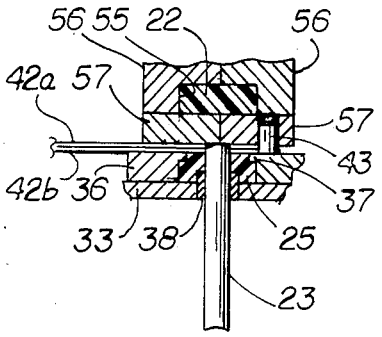
Figure 8:
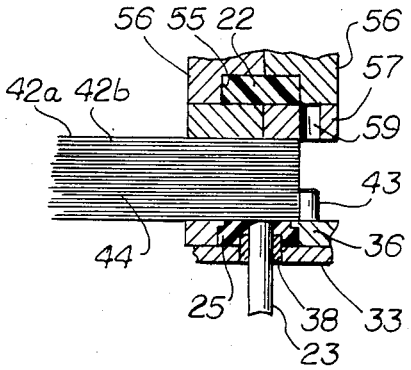
Figure 9:
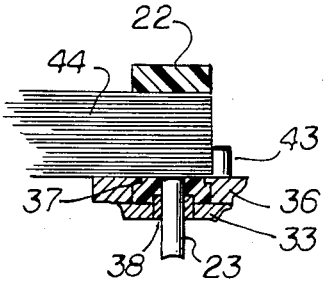

FIG. 4 illustrates the first step in the method of binding a book. A sheet feeder 41 feeds individual sheets 42 or batches of sheets. The sheets 42 may, for example, be discharged from a printing or copying machine, or any other source. Feeder 41 deposits the sheets 42 against a backstop pin 43 so that they are located above female binding element 26. The male strip 22 is moved toward the female strip 25 causing the punch member 24 to shear a hole in first sheet **42*a* as shown in FIG. 5. When the male element 21 is raised, the sheet 42*a* remains with the element, or in other words, the studs 23 are gripped by the holes which have been formed in the first sheet or batch 42*a*. FIG. 6 illustrates a second sheet or batch of sheets 42*b* fed by feeder 41 in the same way as sheet 42*a* was fed. FIG. 7 shows the punch member 24 having sheared holes in sheet 42*b*. When the male element 21 is raised from the position of FIG. 7, both sheets 42*a* and 42*b* will remain therewith. FIG. 8 shows completion of formation of a stack 44 formed of sheets 42*a*, 42*b* and subsequently fed sheets comprising all the sheets of the book to be formed. Pressure is applied to the male binder element 21, compressing the stack 44 against the female element 26 and against the support 33**.

Figure 10:
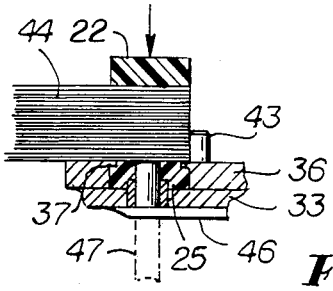
Figure 11:
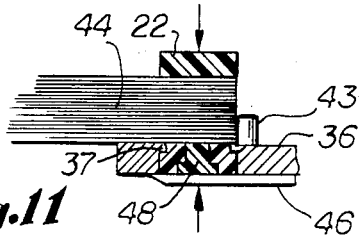
Figure 12:
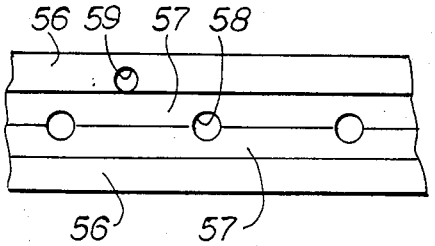
FIG. 12 is top plan view of the guide used to hold the male strip, (the view being shown in closed position)
Figure 13:
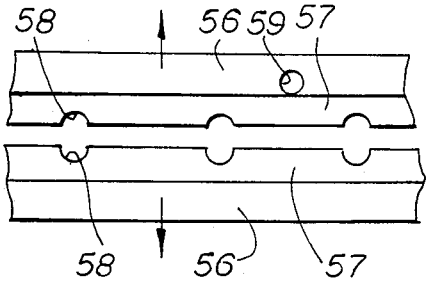
FIG. 13 is a view similar to FIG. 12 showing the guide is open position
Figure 14:
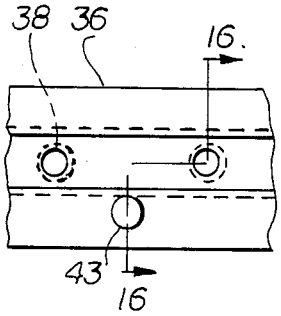
FIG. 14 is top plan view of the guide used to hold the female strip (the view being taken in closed position)
Figure 15:
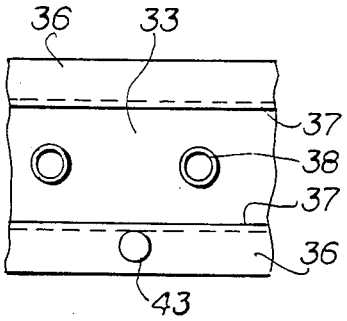
FIG. 15 is a view similar to FIG. 14 showing the guide in open position.
Figure 16:
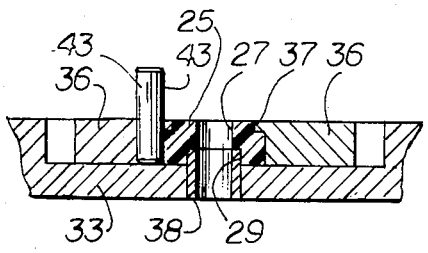
FIG. 16 is a cross-section taken substantially along line 17—17 of FIG. 14.

As will be understood by those versed in the art, various means may be used to form a rivet head. FIG. 10 shows the first step of one means wherein a hot knife 46 preferably heated, cuts off the studs 23 projecting below support 33, the excess stud lengths 47 dropping away. Thereupon the knife 46 is raised, forming from the stud material which projects below female element 26 rivet heads which fill the counterbores 29. When the rivet heads 48 cool, the book is firmly bound, much in the manner of the book shown in U.S. Pat. No. Re. 28,202.

Figure 17:
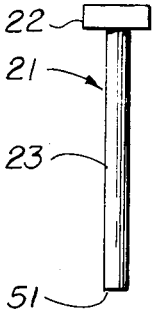
FIG. 17 is a view similar to FIG. 2 of a modified stud.

FIG. 17 shows a punch element 51 at the outer end of the stud **23*a* which is perpendicular to the axis of the stud. In other respects the strip of FIG. 17** is similar to that of the preceding modifications and the same reference numerals designate corresponding parts.

Figure 18:
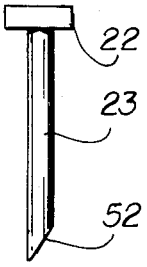
FIG. 18 is a view similar to FIG. 17 of still another modification.

FIG. 18 shows a further modified binder element 21 wherein the lower end of stud 23 is formed with a punch element 52 which is substantially planar but slanted relative to the axis of stud 23. In other respects this modification is similar to that of the preceding modification and the same reference numerals are used to designate corresponding parts.

Figure 20:
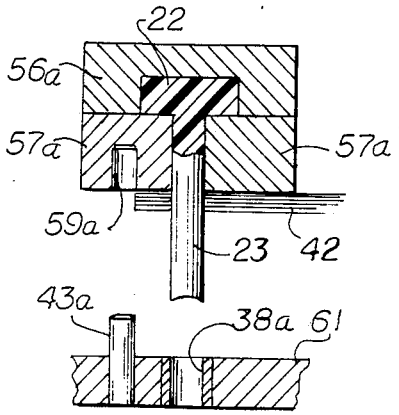
FIGS. 20–23 are schematic views of steps subsequent to FIG. 19.
Figure 21:
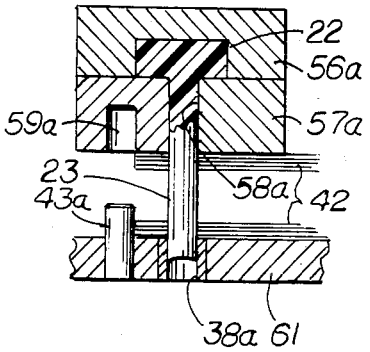
Figure 22:
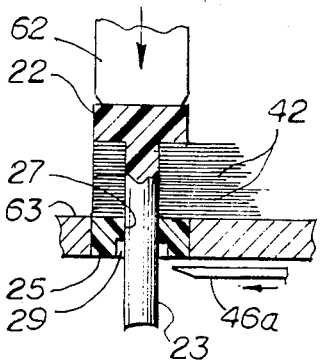
Figure 23:
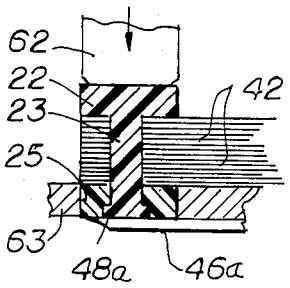

FIG. 19 shows a further modified method for forming the book. Instead of using the female strip 25 as a die cooperating with the stud 23, a hardened steel die 61, which may or may not have sleeves **38*a* incorporated therein, is used. Paper 42 is fed against stop 43*a* on top of the die 61 in the same fashion as previously disclosed. Thereupon, the clamp 56*a* and guide 57*a* are brought toward the die plate 61 causing the die elements 24 in collaboration with the sleeve 36*a* (if used) to punch holes in sheets 42. FIG. 20 shows retraction of clamp 56*a*, the punched sheets 42 traveling with the studs 23. FIG. 21 shows completion of punching a stack of sheets 42. Thereupon, the male strip 22 and sheets 42 attached to the studs 23 are removed from the apparatus of FIGS. 19–21 and placed in a conventional bookbinding machine such as that shown in U.S. Pat. No. 4,354,783 or a predecessor machine. Such a machine may have support 63 formed with a groove to receive the female strip 25. The lower ends of the studs 23 are inserted through the holes 27 in strip 25, with the sheets 42 resting on the support 63. Thereupon, a mechanically or manually driven pressure bar 62 presses down on the strip 22, compressing the sheets 42 against the female strip 25. Thereupon a heated knife 46*a* or other suitable instrumentality cuts off the excess lengths of the studs 23 and then moves upwardly forming a head 48*a* filling the counterbore 29 in strip 25**. It will be understood that various other means may be used to form a head in the counterbore.

Figure 24:
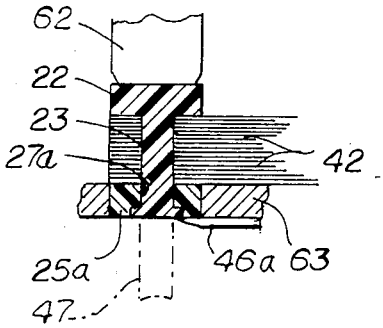
FIG. 24 shows a still further modification.

FIG. 24 shows still another modification. In this modification, strip **25*a* is formed with a hole 27 dimensioned to fit with the outside diameter of stud 23 with a force fit. No counterbore is formed in the strip 25*a*. The strip 25*a* is placed in a groove in the support 63. Thereupon, the pressure bar 62 forces the stud 23 through the hole 27. Knife 46*a* then cuts off the excess stud length 47 close to the bottom surface of strip 25*a*. Thus, the book is held assembled by friction of the studs 23 in holes 27*a***.

Figure 2:
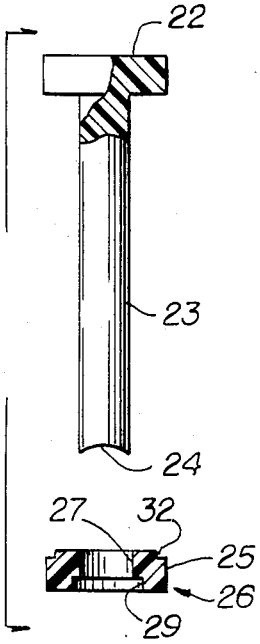
FIG. 2 is an enlarged exploded cross-sectional view taken substantially along the line 2—2 of FIG. 1.
Figure 3:
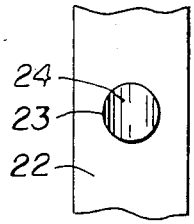
FIG. 3 is a bottom plan view of the binder element of FIG. 1.
Figure 25:
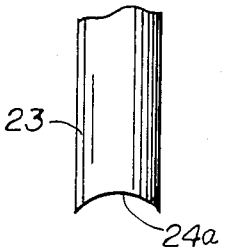
Figure 26:
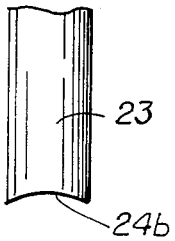
Figure 25A:
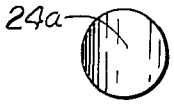
Figure 26A:
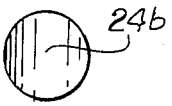

The radius of curvature of the punch member 24 of stud 23 shown in FIG. 2 is subject to considerable variation. FIGS. 25 and 26 show curvatures **24*a* and 24*b* respectively, of progressively larger radii, whereas FIG. 17 shows a blunt end 51** which may be considered of infinite radius of curvature.

Figure 27:
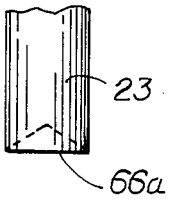
Figure 28:
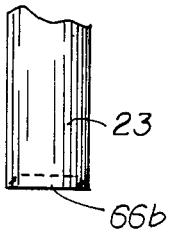
Figure 29:
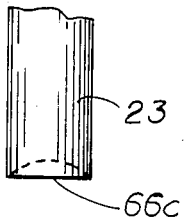
Figure 30:
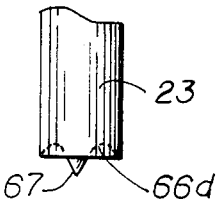
Figure 27A:
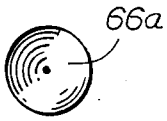
Figure 28A:
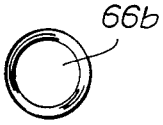
Figure 29A:
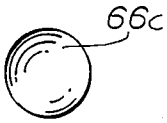
Figure 30A:
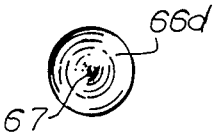

In FIGS. 27–30, the punch members **66–66*a*, respectively, are hollow. In FIG. 27, the hollow 66 is an inverted cone, whereas in FIG. 28 it is a truncated cone. In FIG. 29 the concavity is spheroidal. FIG. 30 shows a spheroidal depression 66*c* with a central pilot cusp 67**.

Figure 31:
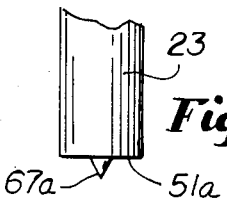

FIG. 31 and **31*a* show a pilot 67*a* protruding in the center of a flat punch element 51*a* similar to the punch 51 of FIG. 17**.

Figure 32:
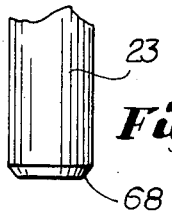
Figure 33:
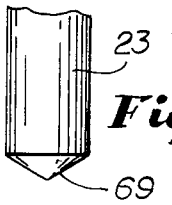
Figure 31A:
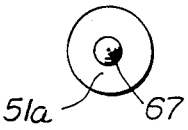
Figure 32A:
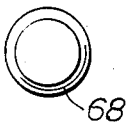
Figure 33A:
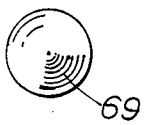
Figure 34:
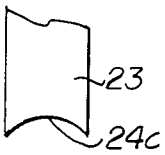
Figure 35:
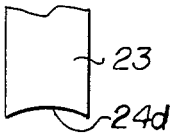
Figure 36:
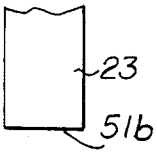
Figure 37:
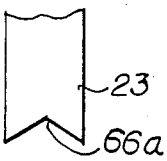
Figure 34A:
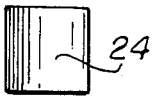
Figure 35A:
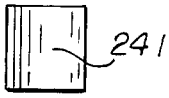
Figure 36A:
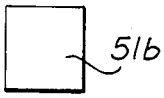
Figure 37A:
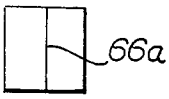

FIGS. 32 and **32*a* show a truncated conoidal punch element 68. FIG. 33 shows a conoidal punch element 69** which is not truncated.

The holes formed by the punch elements heretofore described have been round. As shown in FIGS. 34 through 42, the holes may be square (or with modifications which will occur to one skilled in the art) rectangular. FIGS. 34, 35, 36, 37, 39, 41 and 42 although square, resemble the shapes of the round punch elements shown in FIGS. 2, 25, 17, 27, 33, 28 and 31, respectively, and appropriate subscripts are attached to the reference numerals, to designate corresponding elements.

Figure 38:
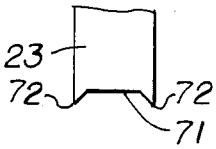
Figure 39:
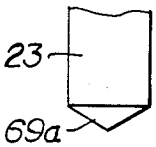

In FIG. 38, the working end of the punch at the center is flat as indicated by the reference numeral 31 and along two side edges slants downwardly-outwardly as indicated by reference numerals 72 so that there are longitudinal sharp edges along the said longitudinal edges.

Figure 40:
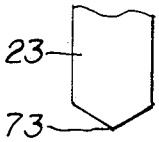
Figure 41:
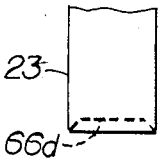
Figure 38A:
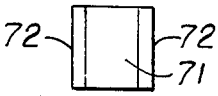
Figure 39A:
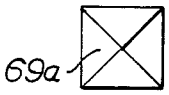
Figure 40A:
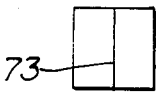
Figure 41A:
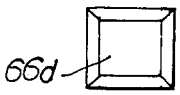
Figure 42:
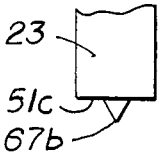
Figure 42A:
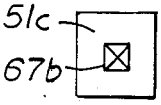

In FIG. 40, the working end of the bit is slanted downwardly-inwardly toward the center so that there is a point 73 extending along the center.

What is claimed is:

1. A method of forming a book from sheets comprising:

(a) providing a first stip having a plurality of thermoplastic studs projecting therefrom at spaced intervals, said studs having elongated cylindrical portions and formed of a material severable into shorter lengths and deformable into heads and shaped to receive said sheets after first holes have been punched therein with said first holes fitting over said studs, the distal ends of said studs being shaped to form first punch means with sharp, radially inwardly extending surfaces forming with said cylindrical portions sharp first corners and the ends of said studs inward of said surfaces being formed concave about axes transverse to the longitudinal axes of said studs;

(b) providing a second strip having a flat planar surface, said second strip being formed with second holes of fixed size spaced at the same intervals as said studs dimensioned to receive said studs, said second holes comprising second punch means, said first holes being formed with sharp second corners with said planar surface, said strips being movable toward each other to accommodate any thickness of sheets fitting over said studs, said first and second punch means differing in size by a clearance such that said first and second punch means punch out of said sheets said first holes complementary to said distal ends of said studs;

(c) punching second holes in a batch of sheets by positioning said sheets between said first and second punch means and forcing said first and second punch means toward each other thereby punching out said second holes in said batch;

(d) retaining said batch on said studs after being punched; and (e) forming rivet heads on said studs by heating and then cooling the same.

2. A method according to claim 1 in which said second strip is formed with depressions at said holes and said heads are formed in said depressions.

3. A method according to claim 1 which further comprises clamping said second strip against movement prior to step (c) and unclamping said second strip after step (c).

4. A method according to claim 1 which further comprises repeating steps (c) and (d) with additional batches of said sheets to build up a stack of sheets on said studs.

5. A method of forming a book from sheets comprising (a) providing a first strip having a plurality of integral thermoplastic studs projecting therefrom at spaced intervals, said studs having elongated cylindrical portions and formed of a material severable into shorter lengths and deformable into heads, the ends of said studs being shaped to receive said sheets after first holes have been punched therein with said first holes fitting over said studs, the distal ends of said studs being shaped to form first punch means with sharp, radially inwardly extending surfaces forming with said cylindrical portions sharp first corners and the ends of said studs inward of said surfaces being formed concave about axes transverse to the longitudinal axes of said studs; a second strip having second holes spaced at the same intervals as said studs dimensioned to receive said studs, said strips being movable toward each other to accommodate any thickness of sheets fitting over said studs;

(b) providing second punch means having a flat planar surface having third holes of fixed size formed therein spaced at the same intervals as said first holes, dimensioned to receive said studs, said third holes forming second punch means, said third holes being formed with sharp second corners with said planar surface, the outsides of said first punch means and the insides of said third holes differing by a clearance such that said first punch means and said third holes punch out of said sheets said first holes shaped complementary to said distal ends of said studs;

(c) punching first holes in a batch of sheets by positioning said sheets betwen said first and second punch means and forcing said first and second punch means toward each other therebypunching out said first holes and removing said second punch means;

(d) retaining said batch on said studs after being punched;

(e) inserting said studs in said second holes of said second strip; and (f) cutting off excess lengths of said studs extending beyond said second strip.

6. A method of forming a book from sheets comprising:

(a) providing a first strip having a plurality of thermoplastic studs projecting therefrom at spaced intervals, said studs having elongated cylindrical portions and formed of a material severable into shorter lengths and shaped to receive said sheets after first holes have been punched therein with said first holes fitting over said studs, the distal ends of said studs being shaped with sharp radially-inwardly extending surfaces to form sharp first corners with said cylindrical portions;

(b) providing a second strip having a flat planar surface, said second strip being formed with second holes spaced at the same intervals as said studs dimensioned to receive said studs, said second holes forming sharp second corners with said planar surface, said strips being movable toward each other to accommodate any thickness of sheets fitting over said studs, said first and second corners comprising punch means, differing by a clearance such that said punch means punch out of said sheets said first holes complementary to said distal ends of said studs;

(c) providing removable guide means shaped to guide movement of said studs and positioning said guide means over said batch of sheets;

(d) punching first holes in a batch of sheets by positioning said sheets between said punch means and forcing said punch means toward each other while guiding said studs by said guide means thereby punching out said first holes in said batch;

(e) removing said guide means from said studs;

(f) retaining said batch on said studs after eing punched; and (g) forming rivet heads on said studs by heating and then cooling the same.

* * * * *